US011207772B2

(12) United States Patent
Hu

(10) Patent No.: US 11,207,772 B2
(45) Date of Patent: Dec. 28, 2021

(54) INSULATED SCREWDRIVER

(71) Applicant: Gong Fong Enterprise Co., Ltd., Tainan (TW)

(72) Inventor: Cheng-Te Hu, Tainan (TW)

(73) Assignee: Gong Fong Enterprise Co., Ltd., Tainan (TW)

( * ) Notice: Subject to any disclaimer, the term of this patent is extended or adjusted under 35 U.S.C. 154(b) by 263 days.

(21) Appl. No.: 16/368,211

(22) Filed: Mar. 28, 2019

(65) Prior Publication Data

US 2019/0299391 A1 Oct. 3, 2019

(30) Foreign Application Priority Data

Mar. 29, 2018 (TW) ..... 107204106

(51) Int. Cl.
*B25G 1/12* (2006.01)
*B25B 23/00* (2006.01)

(52) U.S. Cl.
CPC ..... *B25G 1/125* (2013.01); *B25B 23/0042* (2013.01)

(58) Field of Classification Search
CPC ..... B25G 1/125; B25G 1/12; B25B 23/0042; B25B 13/48; B25B 13/481; B25B 13/5091; B25B 17/00; B25B 23/00; E21B 19/16
See application file for complete search history.

(56) References Cited

U.S. PATENT DOCUMENTS 5,259,277 A * 11/1993 Zurbuchen ..... B25B 15/02 81/177.1
7,437,979 B1 * 10/2008 Wang ..... B25B 15/001 81/436
7,762,161 B2 * 7/2010 Lai ..... B25B 15/04 81/63.1
2005/0092142 A1 * 5/2005 Nish ..... B25B 15/007 81/452
2009/0173192 A1 * 7/2009 Hsieh ..... B25B 23/0035 81/436

* cited by examiner

*Primary Examiner* — Robert J Scruggs
(74) *Attorney, Agent, or Firm* — WPAT, P.C., Intellectual Property Attorneys; Anthony King

(57) ABSTRACT

An insulated screwdriver includes: an insulator, a first metal sleeve, a second metal sleeve, an insulated sleeve, and a handle. The insulator has a first connecting portion and a second connecting portion. The first metal sleeve is disposed on the first connecting portion of the insulator. The second metal sleeve is disposed on the second connecting portion of the insulator, and the second metal sleeve and the first metal sleeve are insulated. The insulated sleeve covers the insulator, the first metal sleeve, and the second metal sleeve. The handle has an accommodating hole for accommodating the insulated sleeve. According to the insulated screwdriver of the present invention, because the first metal sleeve and the second metal sleeve are insulated, there is no electric shock danger for a user, and safety in use of the insulated screwdriver of the present invention may be improved.

8 Claims, 6 Drawing Sheets

INSULATED SCREWDRIVER

BACKGROUND OF THE DISCLOSURE

1. Field of the Disclosure

The disclosure relates to an insulated screwdriver.

2. Description of the Related Art

Conventional screwdrivers have different sizes of metal sleeves for accommodating different sizes or shapes of screwdriver heads. However, a metal sleeve of a conventional screwdriver is not insulated. During use, if a user directly holds and is in contact with the metal sleeve carelessly or for convenience, and the metal sleeve is used to be in contact with an electric working object, the user may be at risk for electric shock.

SUMMARY OF THE DISCLOSURE

The present disclosure provides an insulated screwdriver. In an embodiment, the insulated screwdriver includes: an insulator, a first metal sleeve, a second metal sleeve, an insulated sleeve, and a handle. The insulator has a first connecting portion and a second connecting portion. The first metal sleeve is disposed on the first connecting portion of the insulator. The second metal sleeve is disposed on the second connecting portion of the insulator, and the second metal sleeve and the first metal sleeve are insulated. The insulated sleeve covers the insulator, the first metal sleeve, and the second metal sleeve. The handle has an accommodating hole for accommodating the insulated sleeve.

According to the insulated screwdriver of the present invention, because the first metal sleeve and the second metal sleeve are insulated, there is no electric shock danger for a user, and safety in use of the insulated screwdriver of the present invention may be improved.

DETAILED DESCRIPTION OF THE DISCLOSURE

The present invention provides an insulated screwdriver. Different sizes of sleeves may be disposed on the insulated screwdriver of the present invention, to accommodate different sizes or shapes of screwdriver heads, so that the insulated screwdriver may be applied to different working objects, and may be an all-in-one insulated screwdriver.

Figure 1:
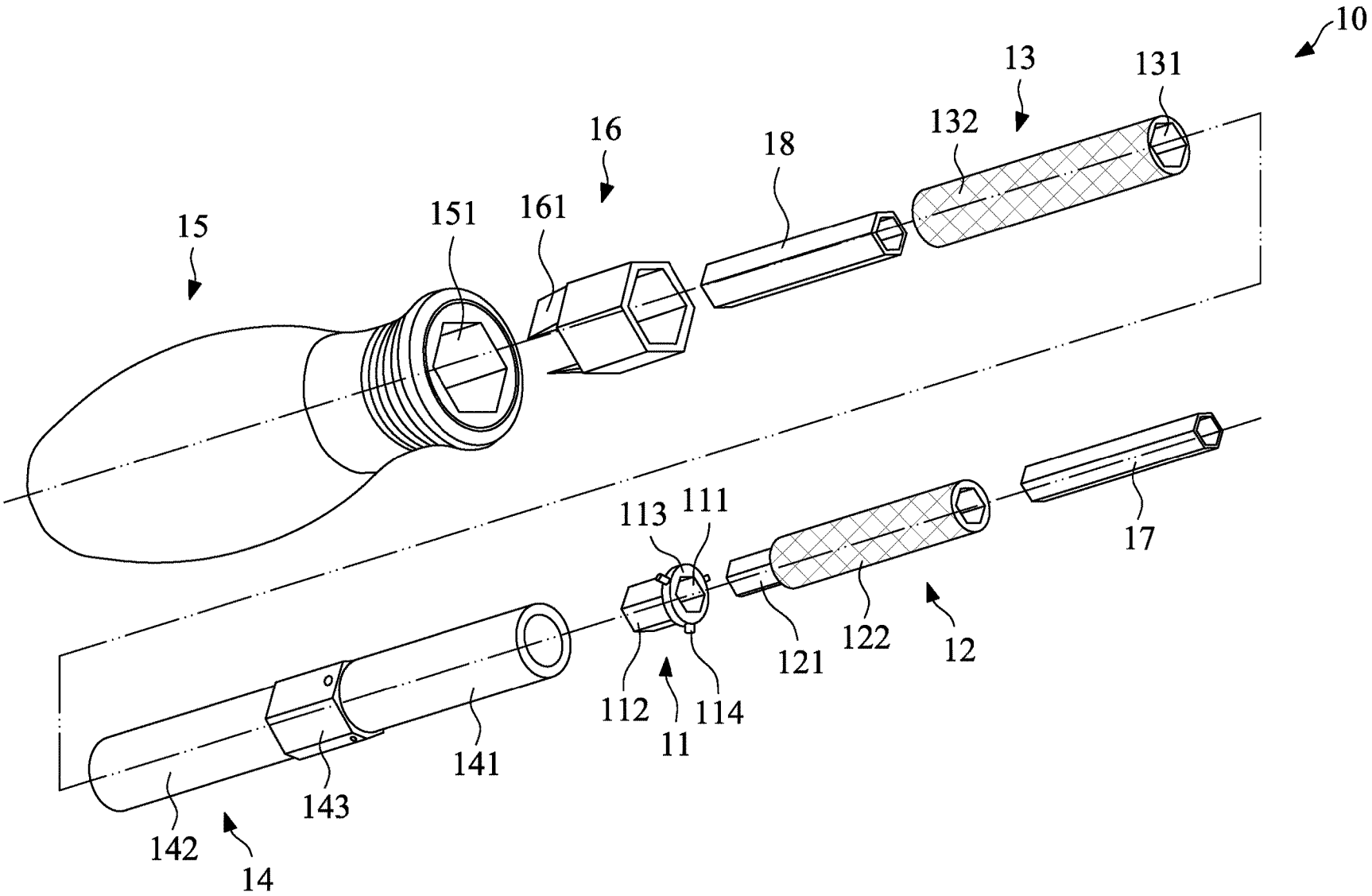
FIG. 1 is a schematic exploded view of an insulated screwdriver according to an embodiment of the present invention.
Figure 2:
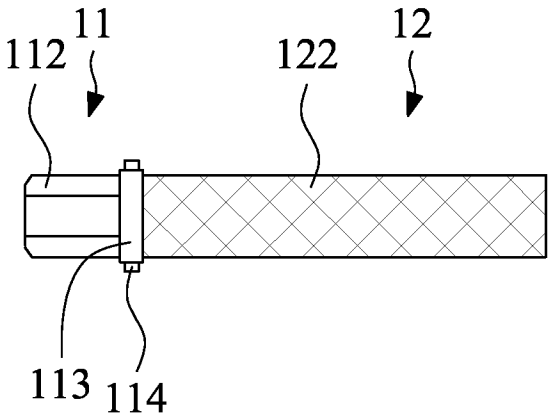
FIG. 2 is a schematic diagram of a first metal sleeve disposed on an insulator according to the present invention.
Figure 3:
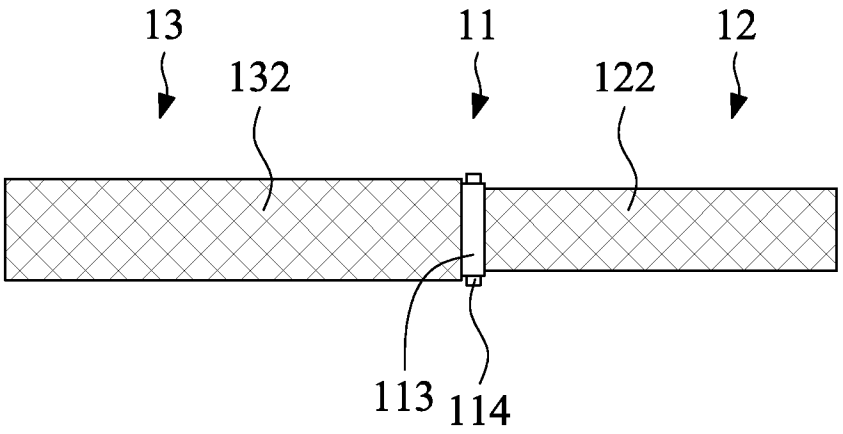
FIG. 3 is a schematic diagram of a second metal sleeve disposed on an insulator according to the present invention.

FIG. 1 is a schematic exploded view of an insulated screwdriver according to an embodiment of the present invention. FIG. 2 is a schematic diagram of a first metal sleeve disposed on an insulator according to the present invention. FIG. 3 is a schematic diagram of a second metal sleeve disposed on an insulator according to the present invention. With reference to FIG. 1 to FIG. 3, an insulated screwdriver 10 of the present invention includes: an insulator 11, a first metal sleeve 12, a second metal sleeve 13, an insulated sleeve 14, and a handle 15.

The insulator 11 has a first connecting portion 111 and a second connecting portion 112. The first metal sleeve 12 is disposed on the first connecting portion 111 of the insulator 11. In an embodiment, the first connecting portion 111 is a blind via. That is, the first connecting portion 111 has an open end and a closed end. The first connecting portion 111 has an inner side wall, and the inner side wall is of an internal hexagon structure. The first metal sleeve 12 has a first combining portion 121. The first combining portion 121 is of an external hexagon structure, and corresponds to the internal hexagon structure of the inner side wall of the first connecting portion 111, so that the first combining portion 121 is inserted in the blind via of the first connecting portion 111, and abuts the closed end.

The second metal sleeve 13 is disposed on the second connecting portion 112 of the insulator 11. In an embodiment, the second connecting portion 112 is an annular column. The second connecting portion 112 has an outer annular wall, and the outer annular wall is of an external hexagon structure. The second metal sleeve 13 has a second combining portion 131. The second combining portion 131 has an inner side wall. The inner side wall is of an internal hexagon structure, and corresponds to the external hexagon structure of the outer annular wall of the second connecting portion 112, so that the second combining portion 131 of the second metal sleeve 13 is disposed on the second connecting portion 112.

After the first metal sleeve 12 and the second metal sleeve 13 are respectively disposed on the first connecting portion 111 and the second connecting portion 112 of the insulator 11, the second metal sleeve 13 and the first metal sleeve 12 are insulated, and there is no electronic connection. In an embodiment, the insulator 11 further includes an isolation ring 113, which is disposed at the open end of the blind via of the first connecting portion 111. An outer diameter of the isolation ring 113 is greater than an outer diameter of the outer annular wall of the second connecting portion 112. Therefore, the isolation ring 113 may isolate the first metal sleeve 12 and the second metal sleeve 13. The insulator 11 may be made of an insulating material, such as plastic.

Figure 4:
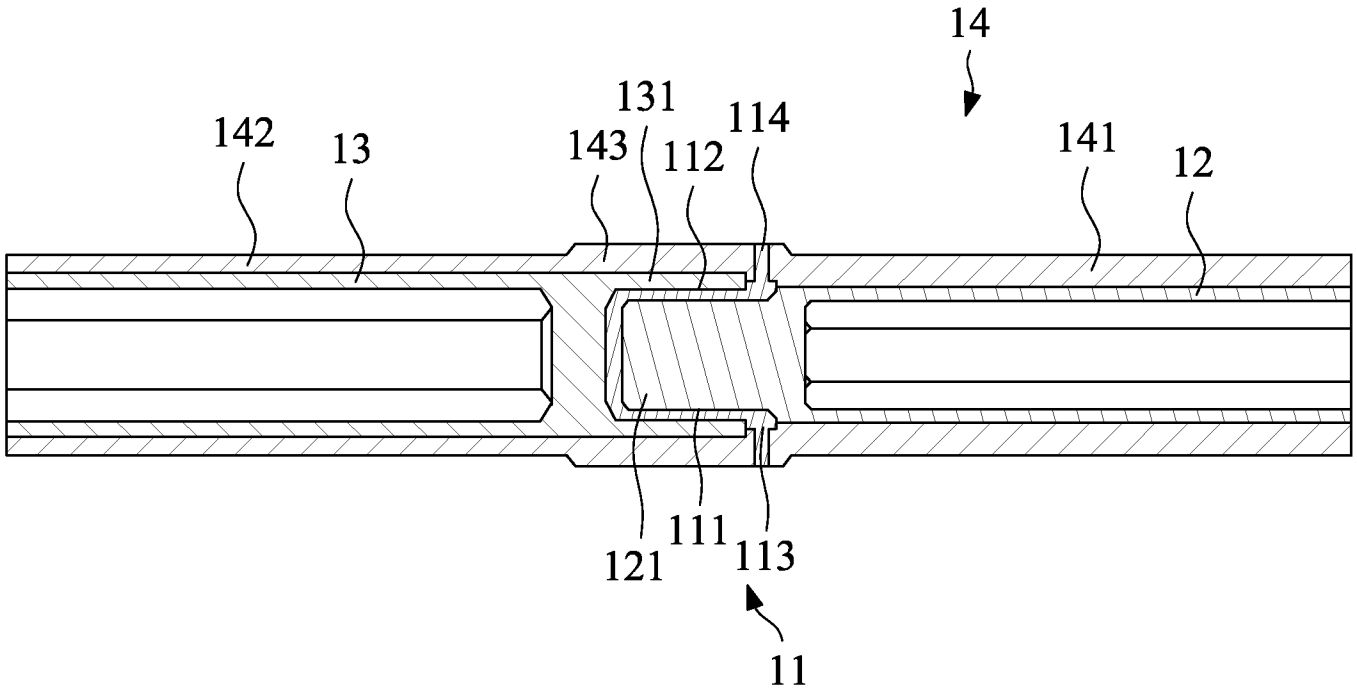
FIG. 4 is a schematic sectional view showing the first metal sleeve, the insulator, and the second metal sleeve are covered by an insulated sleeve according to the present invention.
Figure 5:
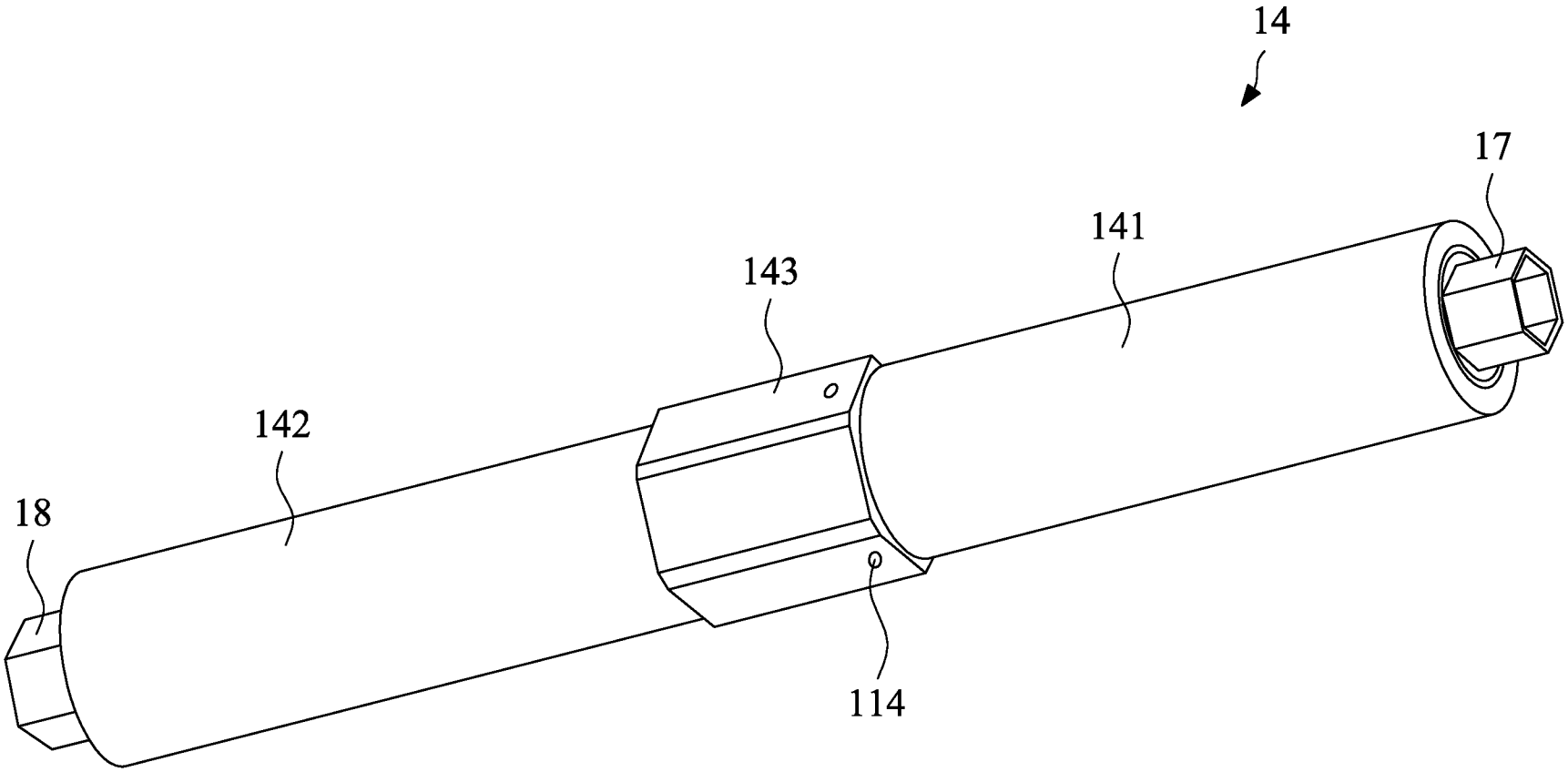
FIG. 5 is a perspective schematic diagram showing the first metal sleeve, the insulator, and the second metal sleeve are covered by the insulated sleeve according to the present invention.

FIG. 4 is a schematic sectional view showing the first metal sleeve, the insulator, and the second metal sleeve are covered by an insulated sleeve according to the present invention. FIG. 5 is a perspective schematic diagram showing the first metal sleeve, the insulator, and the second metal sleeve are covered by the insulated sleeve according to the present invention. With reference to FIG. 1, FIG. 4, and FIG. 5, the insulated sleeve 14 covers the insulator 11, the first metal sleeve 12, and the second metal sleeve 13. During manufacturing, the insulated sleeve 14 may be enabled to cover the insulator 11, the first metal sleeve 12, and the second metal sleeve 13 by means of plastic injection molding. In an embodiment, the insulator 11 further includes a plurality of protruding portions 114, which are disposed on the isolation ring 113. The protruding portions 114 protrude outward and extend. The protruding portions 114 has a positioning effect, so that the insulated sleeve 14 can straight cover the first metal sleeve 12 and the second metal sleeve 13. Moreover, after the insulated sleeve 14 covers the insulator 11, the protruding portions 114 may be exposed on the insulated sleeve 14, to indicate that the second metal sleeve 13 is isolated from the first metal sleeve 12.

In an embodiment, the first metal sleeve 12 includes an outer peripheral surface 122. The outer peripheral surface 122 is a rough surface, and roughening processing or embossing processing may be performed on the outer peripheral surface 122. The second metal sleeve 13 includes an outer peripheral surface 132. The outer peripheral surface 132 is a rough surface, and roughening processing or embossing processing may be performed on the outer peripheral surface 132. The insulated sleeve 14 is wrapped on the outer peripheral surface 122 of the first metal sleeve 12 and the outer peripheral surface 132 of the second metal sleeve 13. Therefore, roughening of the outer peripheral surfaces 122 and 132 may increase a binding force of the insulated sleeve 14 with the first metal sleeve 12 and the second metal sleeve 13. During use, the first metal sleeve 12 or the second metal sleeve 13 cannot easily have relative sliding, to improve the usage stability.

In an embodiment, the insulated sleeve 14 includes a first segment 141, a second segment 142, and a middle segment 143. The first segment 141 covers most of the first metal sleeve 12, the second segment 142 covers most of the second metal sleeve 13, and the middle segment 143 covers the insulator 11, the first combining portion 121 of the first metal sleeve 12, and the second combining portion 131 of the second metal sleeve 13.

Figure 6:
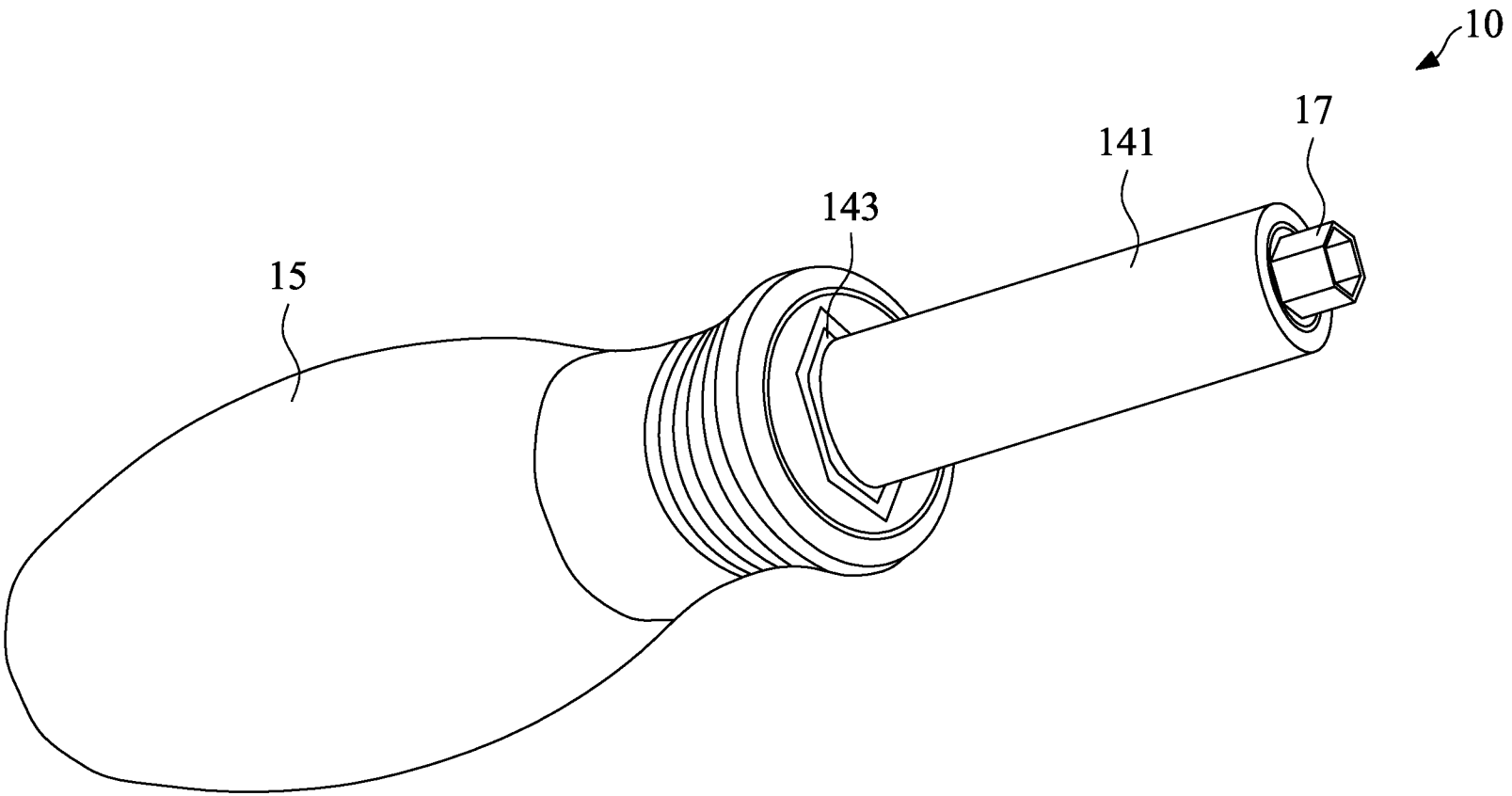
FIG. 6 is a schematic assembly diagram of the insulated screwdriver according to the present invention.

FIG. 6 is a schematic assembly diagram of the insulated screwdriver according to the present invention. With reference to FIG. 1, FIG. 5, and FIG. 6, the handle 15 has an accommodating hole 151 for accommodating the insulated sleeve 14. In an embodiment, the middle segment 143 is of an external hexagon structure, to be correspondingly inserted in the accommodating hole 151 having a corresponding internal hexagon structure. In an embodiment, the insulated screwdriver 10 of the present invention further includes an insertion member 16, which is disposed in the accommodating hole 151 of the handle 15. The insertion member 16 is of an external hexagon structure, and may be correspondingly inserted in the accommodating hole 151 having a corresponding internal hexagon structure. The insertion member 16 includes a plurality of extension portions 161, which are disposed inside the accommodating hole 151 of the handle 15. An inner side wall of the insertion member 16 is of an internal hexagon structure, so that the middle segment 143 of the insulated sleeve 14 may be inserted in the insertion member 16. The insertion member 16 may increase a binding force for clamping the insulated sleeve 14 with the accommodating hole 151, to prevent the insulated sleeve 14 from easily falling off from the accommodating hole 151.

In an embodiment, both the first metal sleeve 12 and the second metal sleeve 13 have internal hexagon structures, and the size of the internal hexagon structure of the first metal sleeve 12 is different from that of the internal hexagon structure of the second metal sleeve 13. Therefore, the first metal sleeve 12 and the second metal sleeve 13 may accommodate different sizes or shapes of screwdriver heads. Moreover, if a small size of screwdriver head is needed, a third metal sleeve 17 may be disposed inside the first metal sleeve 12, or a fourth metal sleeve 18 is disposed inside the second metal sleeve 13. Small and different sizes or shapes of screwdriver heads may be accommodated by using the third metal sleeve 17 or the fourth metal sleeve 18.

During normal use, a part of the insulated sleeve 14 is disposed inside the accommodating hole 151. For example, the second segment 142 and a part of the middle segment 143 of the insulated sleeve 14 are disposed inside the accommodating hole 151, and the first segment 141 and the first metal sleeve 12 or the third metal sleeve 17 are exposed to insert a suitable screwdriver head. In addition, if different sizes of screwdriver heads are needed to be used, only the insulated sleeve 14 needs to be pulled out to change a direction, so that the first segment 141 and a part of the middle segment 143 of the insulated sleeve 14 are disposed inside the accommodating hole 151. The second segment 142 and the second metal sleeve 13 or the fourth metal sleeve 18 are exposed to insert different sizes of screwdriver heads. The insulated screwdriver can be applied to different working objects.

However, for convenience, some users do not dispose the insulated sleeve 14 inside the accommodating hole 151 of the handle 15. A user directly holds the insulated sleeve 14 shown in FIG. 5. For example, the user holds the second segment 142 of the insulated sleeve 14, and inserts a suitable screwdriver head by using the first metal sleeve 12 or the third metal sleeve 17. When holding the second segment 142 of the insulated sleeve 14, a hand of the user may be in contact with the second metal sleeve 13 or the fourth metal sleeve 18. If the first metal sleeve 12 and the second metal sleeve 13 are not insulated, and the first metal sleeve 12 or the third metal sleeve 17 is in contact with an electric working object, the user may be at risk of electric shock.

According to the insulated screwdriver 10 of the present invention, because the first metal sleeve 12 and the second metal sleeve 13 are insulated, even if the user directly holds the insulated sleeve 14 and touches the second metal sleeve 13 or the fourth metal sleeve 18, there is no electric shock danger for the user. The insulated screwdriver 10 of the present invention may improve safety in use.

While several embodiments of the present disclosure have been illustrated and described, various modifications and improvements can be made by those skilled in the art. The embodiments of the present disclosure are therefore described in an illustrative but not in a restrictive sense. It is intended that the present disclosure should not be limited to the particular forms as illustrated and that all modifications which maintain the spirit and scope of the present disclosure are within the scope defined in the appended claims.

What is claimed is:

1. An insulated screwdriver comprising:

an insulator, having a first connecting portion and a second connecting portion;

a first metal sleeve, disposed on the first connecting portion of the insulator;

a second metal sleeve, disposed on the second connecting portion of the insulator, and the second metal sleeve insulated from the first metal sleeve;

a screwdriver head to fit within anyone of said first metal sleeve and said second metal sleeve;

an insulated sleeve, covering the insulator, the first metal sleeve, and the second metal sleeve;

a handle, having an accommodating hole for accommodating the insulated sleeve;

wherein the first connecting portion is a blind via, the first connecting portion has an inner side wall, and the inner side wall is of an internal hexagon structure; the first metal sleeve has a first combining portion, the first combining portion is of an external hexagon structure, and corresponds to the internal hexagon structure of the inner side wall of the first connecting portion; and wherein the second connecting portion is an annular column, the second connecting portion has an outer annular wall, and the outer annular wall is of an external hexagon structure; the second metal sleeve has a second combining portion, the second combining portion has an inner side wall, the inner side wall is of an internal hexagon structure, and corresponds to the external hexagon structure of the outer annular wall of the second connecting portion.

2. The insulated screwdriver according to claim 1, wherein the insulator further comprises an isolation ring, which is disposed at an open end of the blind via of the first connecting portion, and an outer diameter of the isolation ring is greater than an outer diameter of the outer annular wall of the second connecting portion.

3. The insulated screwdriver according to claim 2, wherein the insulator further comprises a plurality of protruding portions, which are disposed on the isolation ring, the protruding portions protrude outward and extend.

4. The insulated screwdriver according to claim 3, wherein the protruding portions are exposed on the insulated sleeve.

5. The insulated screwdriver according to claim 1, wherein the first metal sleeve comprises an outer peripheral surface, the outer peripheral surface is a rough surface, the insulated sleeve is wrapped on the outer peripheral surface of the first metal sleeve.

6. The insulated screwdriver according to claim 1, wherein the second metal sleeve comprises an outer peripheral surface, the outer peripheral surface is a rough surface, the insulated sleeve is wrapped on the outer peripheral surface of the second metal sleeve.

7. The insulated screwdriver according to claim 1, further comprising an insertion member, which is disposed in the accommodating hole of the handle, and the insulated sleeve is inserted in the insertion member.

8. The insulated screwdriver according to claim 7, wherein the insertion member comprises a plurality of extension portions, which are disposed inside the accommodating hole of the handle.

* * * * *